US010920515B2

(12) United States Patent
Roessler et al.

(10) Patent No.: US 10,920,515 B2
(45) Date of Patent: Feb. 16, 2021

(54) DEVICE AND METHOD FOR RETRIEVING A RESTRICTION ELEMENT FROM A WELL

(71) Applicant: GEODYNAMICS, INC., Millsap, TX (US)

(72) Inventors: Dennis Roessler, Fort Worth, TX (US); John Hardesty, Fort Worth, TX (US); Kevin George, Cleburne, TX (US); Michael Wroblicky, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/759,836

(22) PCT Filed: Oct. 10, 2018

(86) PCT No.: PCT/US2018/055122
§ 371 (c)(1),
(2) Date: Apr. 28, 2020

(87) PCT Pub. No.: WO2019/089198
PCT Pub. Date: May 9, 2015

(65) Prior Publication Data

US 2020/0308923 A1 Oct. 1, 2020

Related U.S. Application Data

(60) Provisional application No. 62/579,968, filed on Nov. 1, 2017.

(51) Int. Cl.
*E21B 23/06* (2006.01)
*E21B 33/129* (2006.01)

(52) U.S. Cl.
CPC ..... *E21B 23/06* (2013.01); *E21B 33/1293* (2013.01)

(58) Field of Classification Search
CPC ..... E21B 23/06; E21B 33/1293; E21B 23/04; E21B 23/0413
See application file for complete search history.

(56) References Cited

U.S. PATENT DOCUMENTS 2,781,853 A * 2/1957 Rumble ..... E21B 33/127 166/137
3,311,172 A * 3/1967 Shapiro ..... E21B 23/04 166/212

(Continued)

FOREIGN PATENT DOCUMENTS

WO 2012155197 A1 11/2012

OTHER PUBLICATIONS

International Search Report and Written Opinion issued in related/corresponding International Application No. PCT/US18/55122 dated Jan. 2, 2019.

*Primary Examiner* — Nicole Coy
(74) *Attorney, Agent, or Firm* — Patent Portfolio Builders PLLC

(57) ABSTRACT

A setting tool (402) for setting a plug in a well, the setting tool (402) including a body (404) extending along a longitudinal axis X; a rod (408) extending along the longitudinal axis of the body (404), from an upstream end (402B) to a downstream end (402A) of the body (404); a chamber (406) formed at the downstream end (402A) of the body; and a restriction element (450) located in the chamber (406). The rod (408) extends through the entire chamber (406) and the restriction element (450) is located between the rod (408) and a wall (404A) of the chamber (406).

18 Claims, 10 Drawing Sheets

(56) References Cited

U.S. PATENT DOCUMENTS

| | | | | |
|---|---|---|---|---|
| 5,029,642 | A * | 7/1991 | Crawford | E21B 23/04 166/178 |
| 5,180,009 | A | 1/1993 | Sneed | |
| 5,180,012 | A * | 1/1993 | Crawford | E21B 23/04 166/301 |
| 6,276,690 | B1 * | 8/2001 | Gazewood | E21B 23/01 277/336 |
| 6,341,653 | B1 * | 1/2002 | Firmaniuk | E21B 27/00 166/135 |
| 7,552,766 | B2 * | 6/2009 | Gazewood | E21B 23/01 166/123 |
| 9,004,185 | B2 * | 4/2015 | Madero | E21B 23/06 166/386 |
| 9,765,590 | B2 | 9/2017 | Sullivan | |
| 2010/0314135 | A1 | 12/2010 | Carisella et al. | |
| 2011/0240295 | A1 | 10/2011 | Porter et al. | |
| 2014/0345874 | A1 | 11/2014 | Campbell | |
| 2015/0252643 | A1 | 9/2015 | Mailand et al. | |
| 2016/0376869 | A1 | 12/2016 | Rochen et al. | |
| 2017/0089166 | A1 | 3/2017 | Sullivan | |
| 2018/0266215 | A1 * | 9/2018 | Fagley, IV | E21B 31/113 |
| 2020/0149368 | A1 * | 5/2020 | Yoshida | E21B 23/06 |
| 2020/0157902 | A1 * | 5/2020 | Covalt | E21B 23/06 |

* cited by examiner

DEVICE AND METHOD FOR RETRIEVING A RESTRICTION ELEMENT FROM A WELL

BACKGROUND

Technical Field

Embodiments of the subject matter disclosed herein generally relate to downhole tools for well operations, and more specifically, to a wellbore bottom setting tool that sets a restriction element and a plug at a desired depth into the well.

Discussion of the Background

During well exploration, various tools are lowered into the well and placed at desired positions for plugging, perforating, drilling, or measuring the well. These tools are placed inside the well with the help of a conduit, as a wireline, electric line, continuous coiled tubing, threaded work string, etc. Plugs are used to separate various sections of the well for perforating and/or fracturing purposes. The plugs block the casing so that a fluid from cannot pass the plug. The plugs need to be engineered to withstand a high pressure (thousands of psi) that is traditionally applied to the well, but also to be easily milled away after they have performed their duty.

A traditional plugging system 100 is shown in FIG. 1 and includes a plug 120 that is carried with a setting tool 102 and placed in a well 110, which was drilled to a desired depth H relative to the surface 112. Note that FIG. 1 shows the plug 120 already being set and detached from the setting tool 102. A casing string 114 (or simply casing herein) for protecting the wellbore 116 has been installed and cemented in place. To connect the wellbore 116 to a subterranean formation 118, the plug 120 needs to be set up in the well as shown in FIG. 1 and also to be closed so that well fluids cannot pass the plug.

The typical process of connecting the casing 114 to the subterranean formation 118 may include the following steps: (1) setting the plug 120, which has a through port 122 inside the well, (2) closing the port 122 to block fluid flow through the plug, (3) increasing the pressure inside the casing, and (4) perforating the casing 114 with a perforating gun 126. A controller 130, located at the surface 112, is used to control the various tools and/or the fluid's pressure inside the wellbore 116. In one application, a wireline tool 124 may be used to lower the setting tool 102, the plug 120, and the perforating guns 126.

The structure of the traditional setting tool 102 and plug 120 is illustrated in FIG. 2. The setting tool 102 has a power charge 202, which when ignited, makes a mandrel 204 to move relative to a sleeve 206 so that a rod 208 pulls a piston 210 toward the setting tool 102. Plug 120 is disposed around the rod 208 and between the sleeve 206 and the piston 210, as shown in the figure. Under the opposite forces exerted by the piston 210 and the sleeve 206, a first part 212 of the plug 120 moves toward a second part 214 of the plug so that a slip portion 216 moves over the second part 214 and engages the casing (not shown in FIG. 2). After a certain force is applied to the two parts 212 and 214, the piston 210 breaks away from the rod 208 and the setting tool 102 is freed from the plug 120. At this point, the plug 120 is set (i.e., the slip portion 216 has engaged the casing) and the setting tool 102 can be retrieved from the well. A passage (not shown) through the plug 120 allows fluid communication between the part of the casing above the plug and the part of the casing below the plug.

To close this passage for preparing the well for perforating and/or fracturing, the setting tool 102 needs to be taken out of the well, a ball is introduced into the well and pumped down until the ball sits into a seat 218 located at a proximal end of the plug 120. The ball (not shown) closes the passage and the fluid pressure inside the well and above the plug 120 can be increased. However, the operation of taking the setting tool outside the well and then pumping down the ball is time consuming and expensive. Further, the existing plugs, although made from composite materials, still require a substantial amount of time to be milled out, when the need appears to remove them.

A more efficient plug is illustrated in FIG. 3, which corresponds to FIG. 14 of U.S. Pat. No. 9,765,590. FIG. 3 shows a setting tool 102 having a sleeve 206 in which a trap 302 for trapping the ball 310 is located. A catching mechanism 304 for the ball 310 is also located inside a chamber 312 defined by the sleeve 206. A shear ring 314 connects the sleeve 206 to the plug 120. After enough force is exerted by the setting tool 102, and the plug 120 is set, the shear ring 314 breaks and the setting tool 102 separates from the plug 120. In this embodiment, the ball 310 is carried inside the chamber 312 of the sleeve 206 and there is no need to remove the setting tool in order to place the ball in its seating position in the plug. When the ball needs to be removed, a back flow is established inside the well so that the ball moves past the trap 302, inside the chamber 312. Once the ball has passed the trap 302, the ball cannot return to the plug 120. However, the catching mechanism 304 and the entire structure of the setting tool is complicated.

Thus, there is a need for a setting tool and plug that have a simplified structure, are easy to install, and the plug has minimal resistance to the milling operation.

SUMMARY

According to an embodiment, there is a setting tool for setting a plug in a well. The setting tool includes a body extending along a longitudinal axis X; a rod extending along the longitudinal axis of the body, from an upstream end to a downstream end of the body; a chamber formed at the downstream end of the body; and a restriction element located in the chamber. The rod extends through the entire chamber and the restriction element is located between the rod and a wall of the chamber.

According to another embodiment, there is a setting tool-plug system for plugging a well. The setting tool-plug system includes a setting tool having a rod, a plug having an upper cone part and a lower slip part, and a restricting element sitting inside a chamber of the setting tool and configured to block a fluid flow through the plug. The rod extends out of the setting tool, through the entire plug, and the rod has a first shear element for engaging the lower slip part and a second shear element for engaging the upper cone part.

According to still another embodiment, there is a method for plugging a well, the method including a step of lowering a setting tool-plug system into a well, wherein the system includes a setting tool and a plug, a step of actuating the setting tool so that a rod is pulled from the plug, a step of setting the plug, wherein the plug has an upper cone part and a lower slip part, and wherein by pulling the rod out of the plug results in the lower slip part moving closer to the upper cone part and forming a seal between a casing of the well and the plug, and a step of pulling away the setting tool so that a restricting element sitting inside a chamber of the setting tool, is released from the chamber to block a fluid flow through the plug. The rod extends out of the setting tool, through the entire plug, and the rod has a first shear element for engaging the lower slip part and a second shear element for engaging the upper cone part.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a plug having a single set of slips. However, the embodiments discussed herein are also applicable to any plug.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, there is a setting tool that includes a ball and a plug that accepts the ball. The setting tool is attached via a rod to the plug. The setting tool sets the plug by pulling the rod out of the plug. One or more shear elements holds the plug attached to the rod. When the rod is pulled out with a first force, the plug is set. When the rod is further pulled with an increased second force, the shear elements shear and the rod is removed from the plug. The rod moves together with the setting tool. The passage occupied by the rod in the plug allows for fluid communication between the part downstream from the plug and the part upstream of the plug. The ball is released from the setting tool and sits in a sitting position in the plug to block fluid flow through the passage. The plug has a structure that requires minimum milling for removing it. Thus, according to this embodiment, there is no need to remove the setting tool for placing the ball into the well, and also there is no need for intensive milling when removing the plug.

Figure 1:
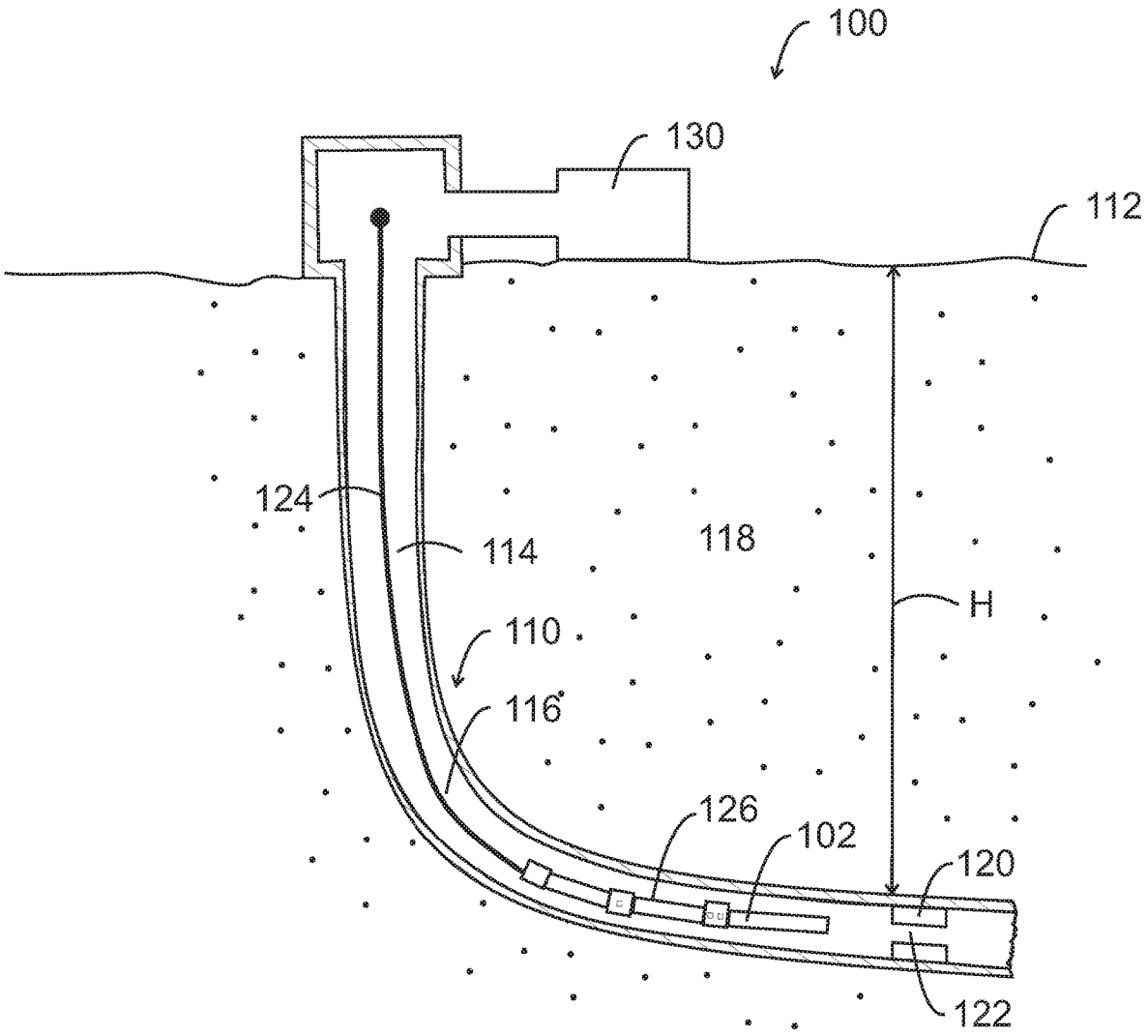
Fig. 1 (Background Art)
FIG. 1 illustrates a setting tool and plug that are used to plug a well.
Figure 2:
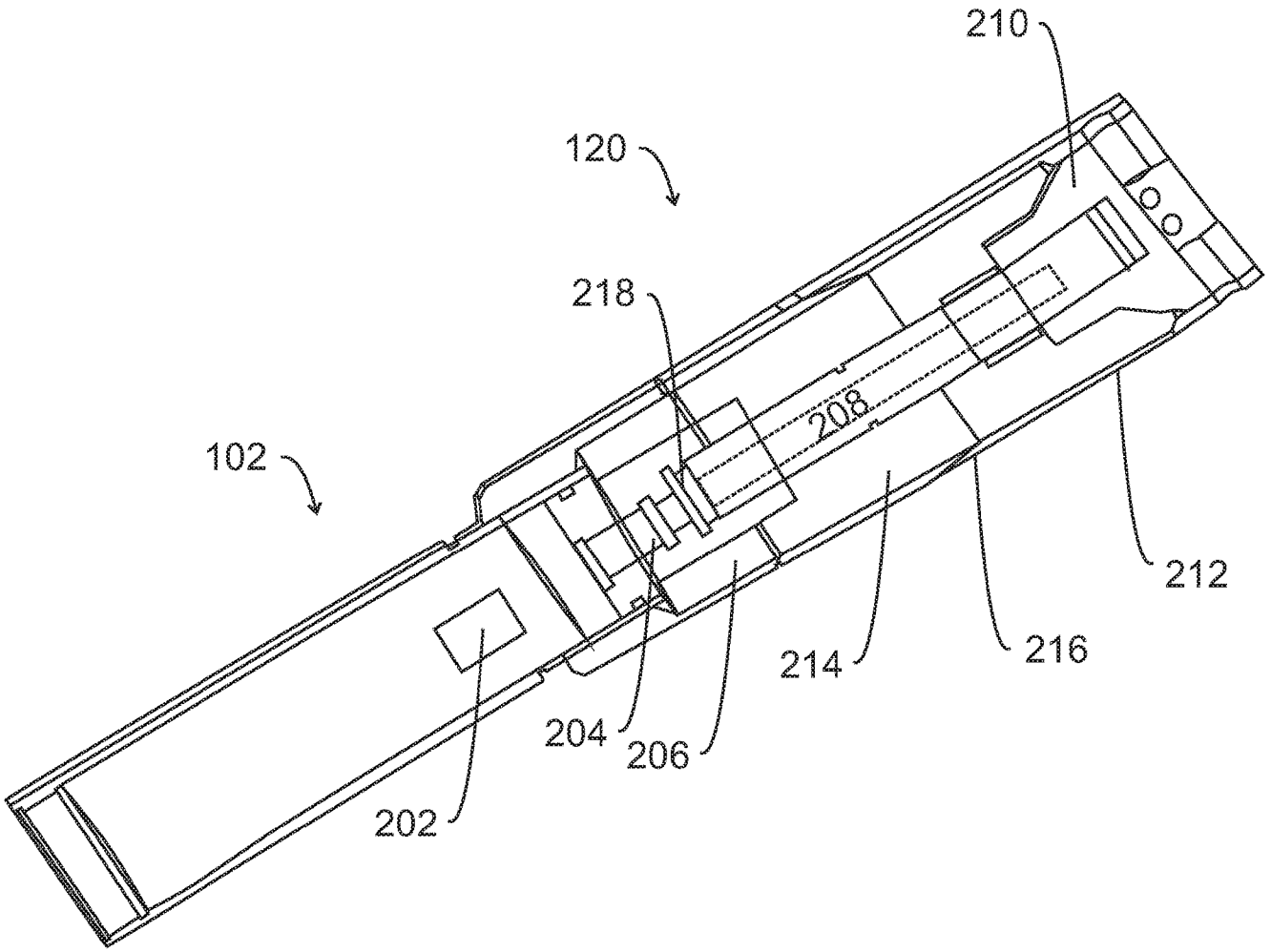
FIG. 2 illustrates a traditional setting tool and plug.
Figure 3:
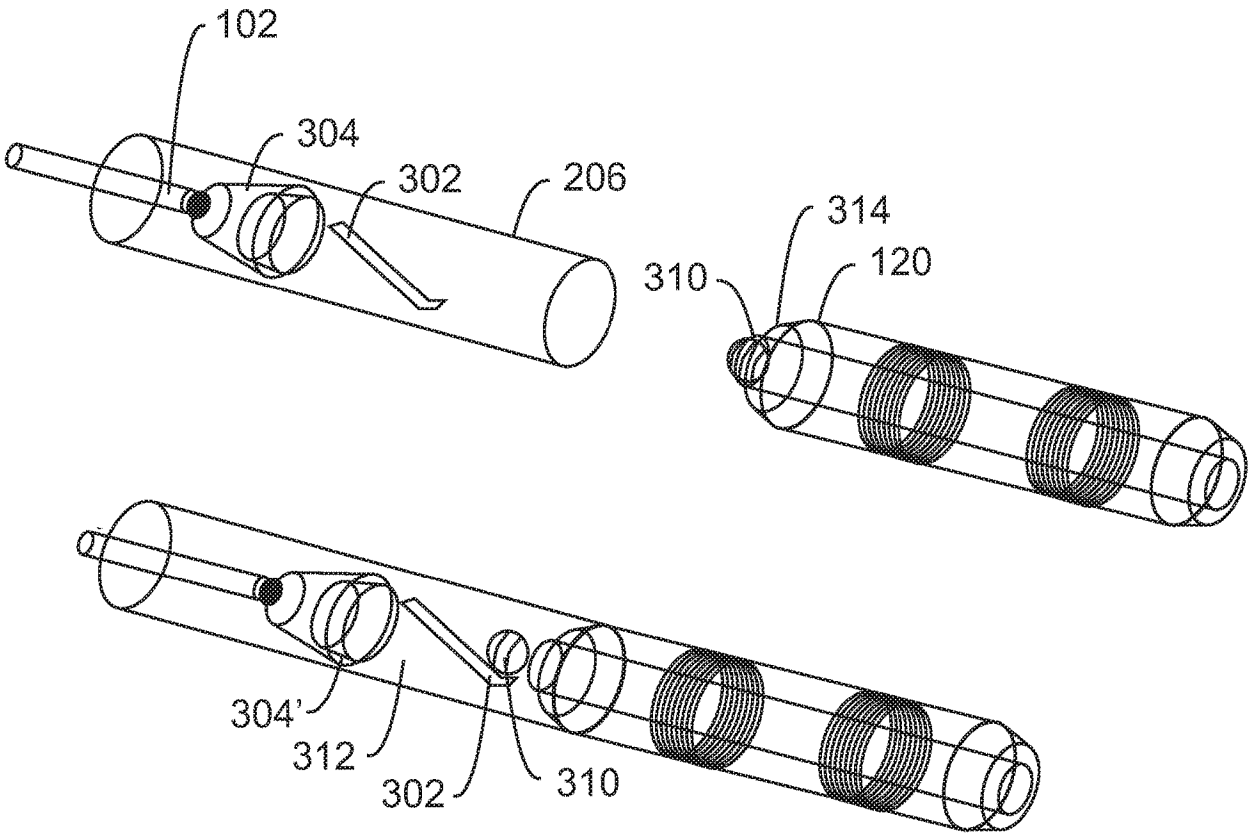
FIG. 3 illustrates another traditional setting tool and plug that includes a ball.
Figure 4:
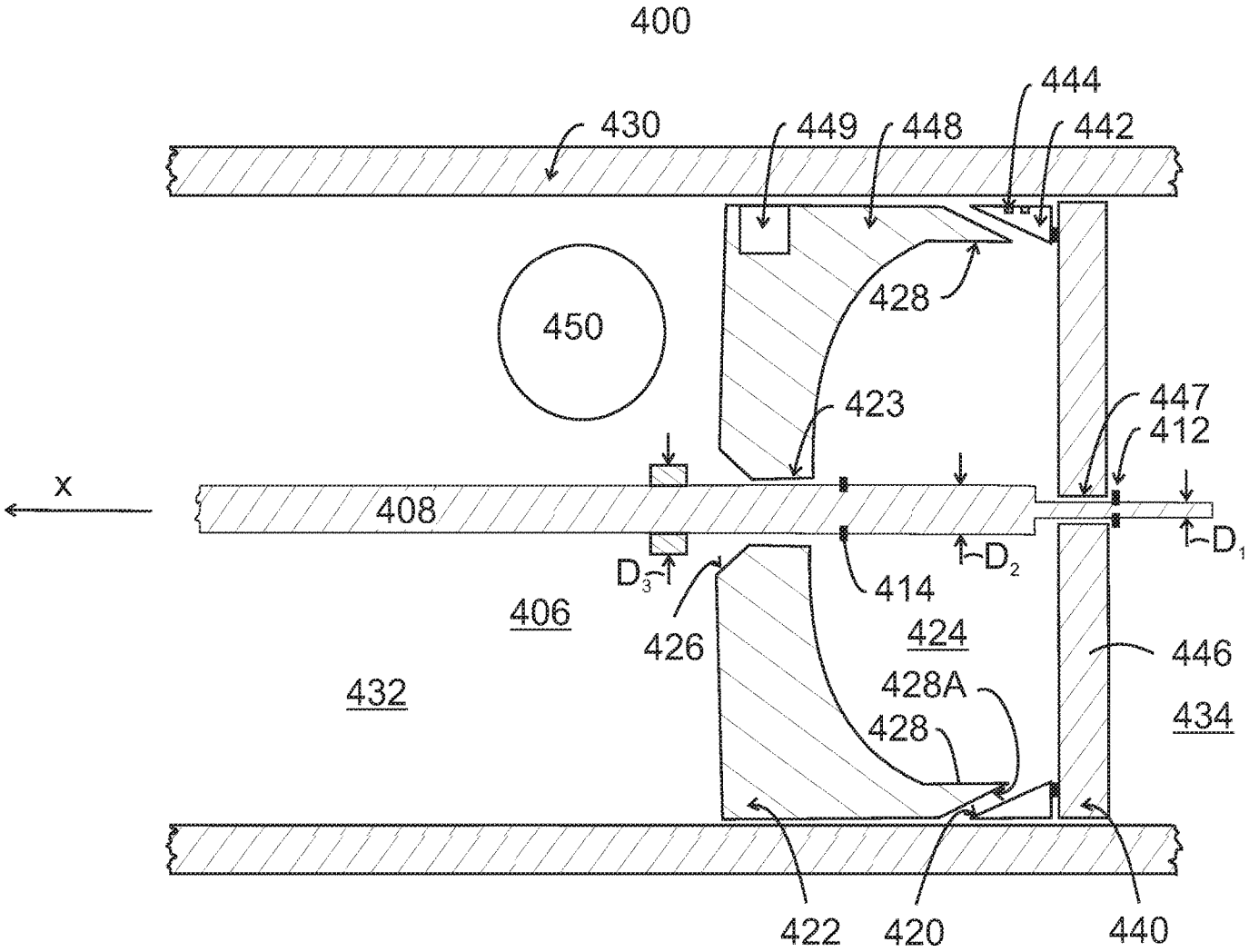
FIG. 4 illustrates a plug having a single set of slips.
Figure 5:
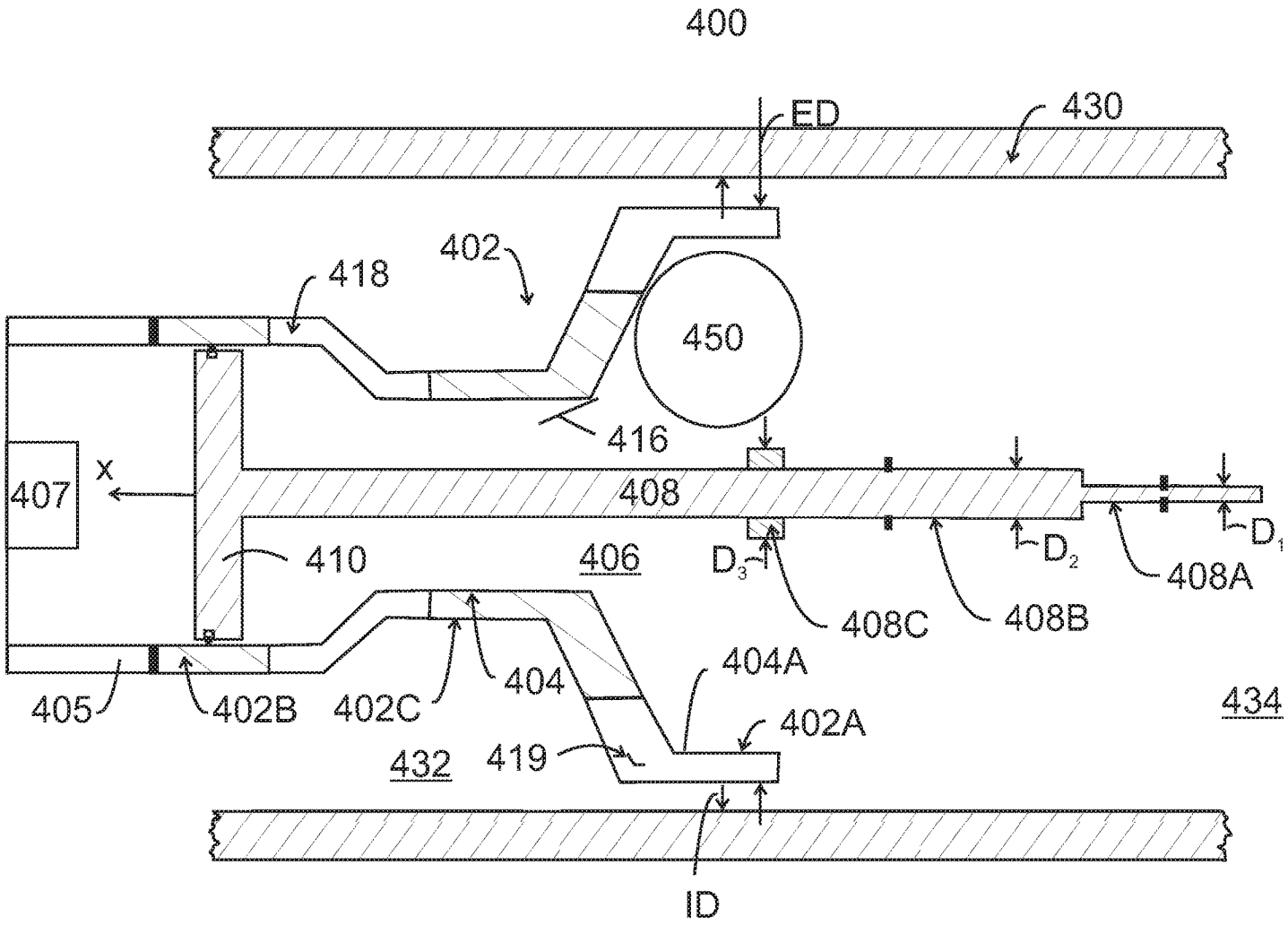
FIG. 5 illustrates a setting tool that houses a ball.
Figure 6:
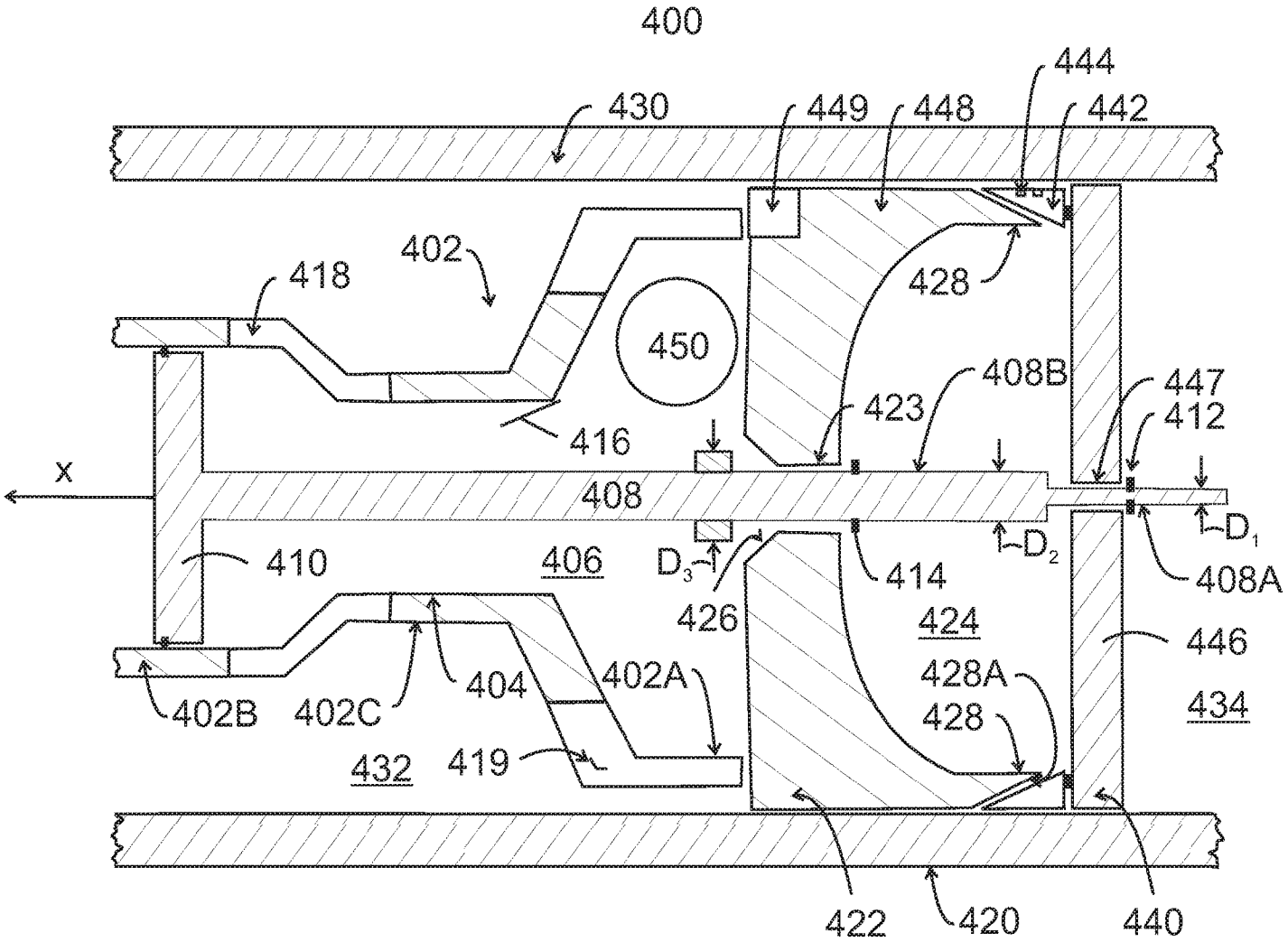
FIG. 6 illustrates a setting tool-plug system that includes the elements illustrated in FIGS. 4 and 5.

A setting tool-plug system 400 that includes a novel setting tool 402 and a novel plug 420 is now discussed with regard to FIGS. 4-6. FIG. 4 shows the plug 420 and a rod 408 that belongs to the setting tool 402. The plug is discussed first followed by a discussion of the setting tool. Plug 420 is configured to seal a casing 430 so that fluid communication between the upstream portion 432 of the casing and the downstream portion 434 is interrupted. The upstream and downstream portions are defined relative to the head and toe of the well. In this regard, the portion between the plug and the head of the well is considered to be upstream while the portion between the plug and the toe of the well is considered to be downstream. This is so irrespective of whether the well is vertical, horizontal or mixed.

In one embodiment, the plug 420 includes two parts, an upper cone part 422 and a lower slip part 440. The upper cone part 422 may be cylindrically shaped and made, for example, from a composite or other material or materials that can be easily machinable. The upper cone part 422 has a central hole 423. A substantial amount of material has been removed from the upper cone part 422 to form a large inner chamber 424, so that the milling operation for removing the plug can proceed faster. The central hole 423 is used to guide the milling machine. However, a main purpose for the central hole 423 is to act as a check valve, such that fluid inside the casing can flow from the upstream portion to the downstream portion and vice versa. A restriction element 450 (for example, a ball) may be used to stop the flow when desired. In this regard, note that when the ball 450 is sitting in its seat 426 formed in the upper cone part 422 (see, for example, FIG. 9), the ball stops the downward flow of the fluid in the well, and thus the pressure upstream the plug can be built up, after the guns were fired, to fracture the perforations made by the guns. One reason why the ball is required to be in its seating is because if the next operation fails, e.g., the guns perforating the casing, the well can be flowed backwards and catch the ball. If the ball is retrieved, the fluid can flow through the plug so that the next gun can be pumped down.

The upper cone part 422 has a wedge or cone 428, as illustrated in FIG. 4, which has an inclined surface 428A facing the casing 430. Wedge 428 is designed to act as a ramp for the slips 442 of the lower slip part 440. Thus, when the lower slip part 440 is forced against the upper cone part 422 (as discussed later), the wedge 428 forces the slips 442 against the casing 430. The wedging force and the friction associated it, between the slips 442 and the casing 430, is used to provide resistance to movement of the plug due to the pressure applied by the fluid inside the well. Note that slips 442 may have one or more metallic and/or ceramic pads 444 formed in the body of the slips to better engage the casing and prevent slipping when the pressure is high within the casing.

Slips 442 may be implemented as a cylindrical part with wedges segmented at the top and a plate 446 at the bottom for holding the wedges together. Plate 446 has a hole 447 centered with hole 423 so that the rod 408 of the setting tool can pass through both of them. Slips are typically cylindrical and may be formed either as one piece, joined, or bonded segments, or individual segments held together with a retaining ring. The slips 442 may be designed to deform radially (or break, expand or flower) outward when the plug component parts are forced toward each other.

In one embodiment, the plug 420 has slips 442 only on one part of the seal part 448, toward the downstream part of the casing. Note that the traditional plugs have two sets of slips, one set below the seal and one set above the seal. The seal part 448 of the upper cone part 422 bends outwardly, when the lower slip part 440 is pushed toward the upper cone part 422 so that the plug is set due to the pressure exerted by the seal part 448 against the casing 430. Optionally, the upper cone part 422 has a slot 449 which may be used when milling out the plug for preventing a rotation of the plug.

The setting tool 402, as illustrated in FIG. 5, has a body 404 shaped to have a large diameter at the downstream end 402A, a smaller diameter in the middle part 402C, and again a large diameter at the upstream end 402B. In one application, the diameter of the downstream end 402A is larger than a diameter of the upstream end 402B. The reason for this shape is because the body 404 forms a chamber 406 at the downstream end 402A and this chamber should be large enough to accommodate the ball 450. In one application, an internal diameter of the chamber 406 is about 3½ in and a diameter of the ball is about 1¼ in. For this specific example, the diameter of the middle part 402C may be about 1⅜ in and the diameter of the upstream end 402B may be about the same as or smaller than the diameter of the downstream end 402A. In another application, the diameter of the middle part 402C is at least as large as the diameter of the ball so that the ball can pass through the middle part. In still another application, the diameter of the downstream end 402A is at least twice the diameter of the ball. More specifically, in one embodiment, the diameter of the downstream end 402A can be twice the diameter of the ball 450 plus the diameter of the rod 408 so that the ball fits in chamber 406, between the rod 408 and a wall 404A of the body 404, as illustrated in FIG. 5. If this is the case, then an external diameter ED of the downstream end 402A substantially matches an internal diameter ID of the casing 430 (the term "substantially" in this context means that the ED is not more than 5% smaller than the size of the ID), as also shown in FIG. 5. Note that in this embodiment the external diameter of the middle part 402C and the upstream end 402B are smaller than the internal diameter of the casing so that a flow of the fluid past these two regions is not affected by the speed of the setting tool relative to the casing. The body 404 may continue or may be attached to another part 405 of the setting tool 402 and this part 405 is configured to hold an actuation mechanism 407. The actuation mechanism 407 may include a power charge, electrical device, or hydraulic device as used in the art.

The setting tool 402 includes the rod 408 that extends through the plug 420, as illustrated in FIG. 4. Rod 408 is attached to a piston 410, which is actuated by the actuation mechanism 407. When actuated, the piston 410 pulls the rod 408 out of the plug 420. FIG. 6 shows the rod 408 extending through the hole 423 formed in the upper cone part 422 and through the hole 447 of the lower slip part 440. Two different shear elements 412 and 414 are connected to the rod 408 so that a pulling of the rod makes the lower slip part 440 to move in an upstream direction, toward the upper cone part 422. In one application, the shear elements 412 and 414 are shear rings or pins. However, those skilled in the art would know that other shear devices may be used.

To prevent the upper cone part 422 and the lower slip part 440 from sliding along the rod in an upstream direction, the rod is manufactured to have varying diameters as illustrated in FIGS. 5 and 6. For example, a first portion 408A of the rod 408 has a first diameter D1 (downstream the lower slip part 440 as shown in FIG. 6), a second portion 408B of the rod has a second diameter D2 (upstream the lower slip part 440 and downstream the upper cone part 422 in FIG. 6), and a third portion 408C of the rod has a third diameter D3 (upstream the upper cone part 422). A value of the first diameter D1 is smaller than a value of the second diameter D2, and the value of the second diameter D2 is smaller than a value of the third diameter D3. A diameter of the first hole 447 is smaller than the second diameter of the rod and a diameter of the second hole 423 is smaller than the third diameter of the rod.

Returning to FIG. 5, a trap mechanism 416 is formed inside the middle part 402C of the body 404 of the setting tool 402. The trap mechanism 416 may include a spring band (cantilever type) that is attached with one end to the body 404 and the other end extends toward a longitudinal axis X of the body. If the ball 450 arrives at the trap mechanism 416 along an upstream direction (which coincides in this figure with the positive direction of the X axis), then the ball will bend the spring band 416 toward the body 404 while passing the middle part 402C (it is assumed for this discussion that the rod 408 has been removed from the body 404). After passing the trap mechanism 416, the spring band returns to its initial position, which prevents the ball 450 from rolling downstream. In other words, once the ball 450 passes the trap mechanism 416 in the upstream direction, the ball cannot return to the plug. Other trap mechanisms may be used as they are known in the art. Ball 450 may be made from any material, degradable or not when interacting with the fluid in the well.

Still with regard to FIG. 5, the body 404 has plural holes 418 distributed along the external perimeter of the setting tool to allow a fluid inside the well to pass through. A size of each of the hole 418 is smaller than a diameter of the ball so that the ball cannot escape from an inside of the setting tool. One or more radial slots are also formed at the downstream end 402A of the setting tool to also allow a flow of the fluid inside the well through the body 404. The slots are narrow enough such that the ball does not pass through them. In this way, the fluid inside the well passes through the entire body of the setting tool when the setting tool is lowered or raised in the well. In other words, the fluid inside the well will pose minimum resistance to the movement of the setting tool through the casing.

Figure 7:
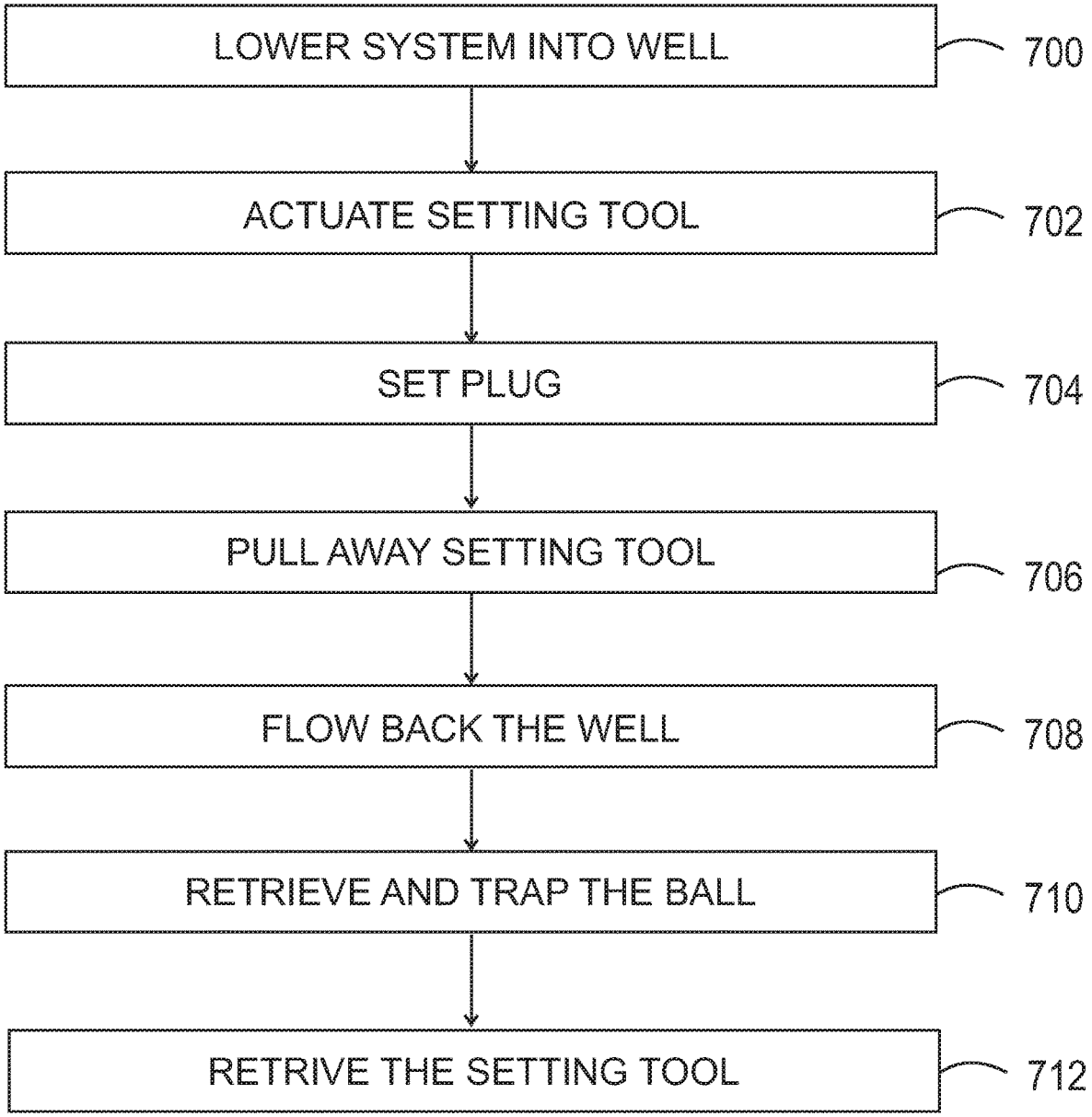
FIG. 7 is a flowchart of a method for setting up a plug with the setting tool-plug system of FIG. 6.
Figure 8:
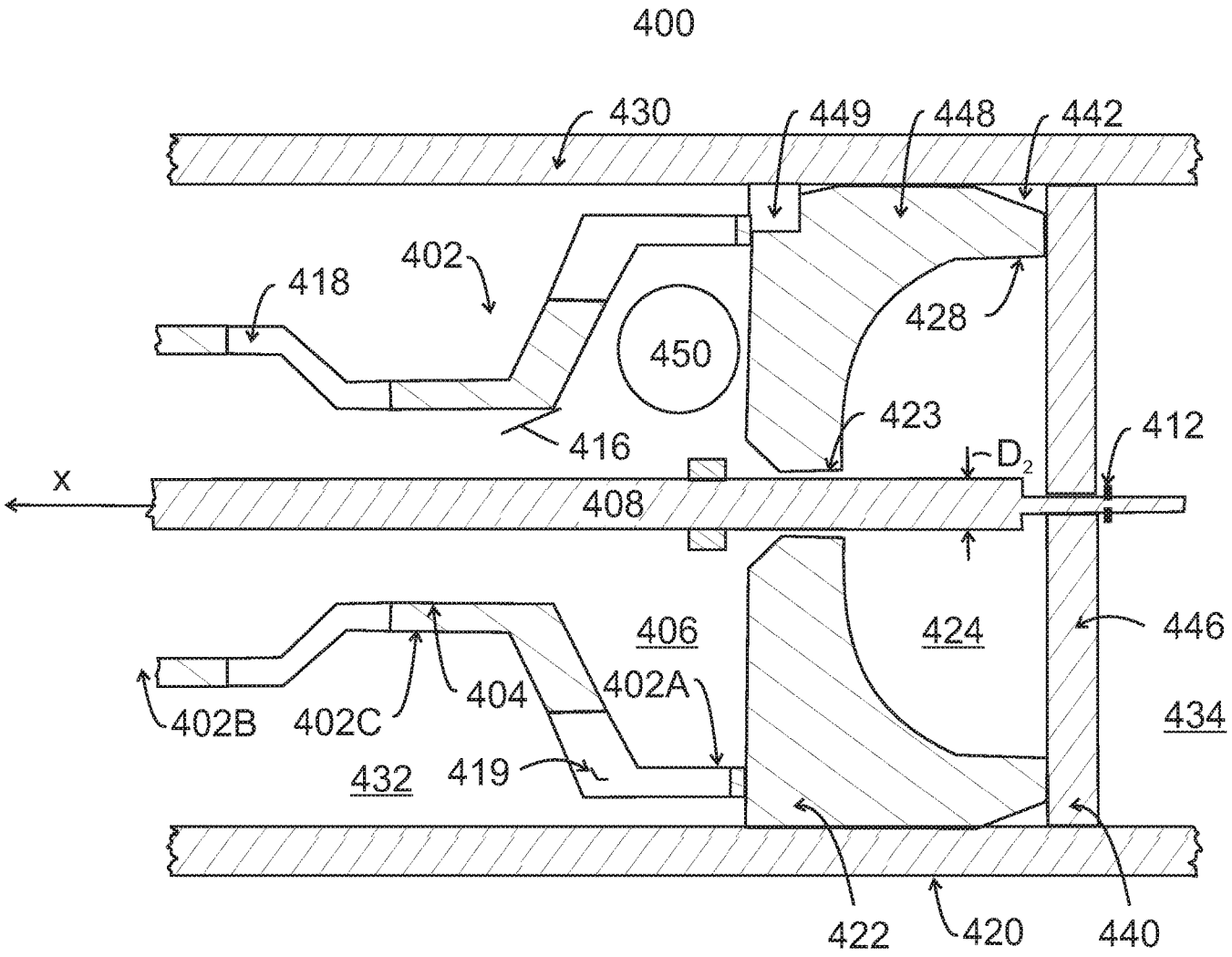
FIG. 8 illustrates how the setting tool sets the plug.

FIG. 6 shows the setting tool 402 and the plug 420 attached to each other. A method for setting the plug with the setting tool and controlling the flow through the plug is now discussed with regard to FIG. 7. The setting tool-plug system 400 shown in FIG. 6 is lowered in step 700 into the well, in this configuration, to a desired depth of the well. Once the system has arrived at the desired depth, the setting tool 402 is actuated in step 702, from the surface, through a wireline or equivalent device. During the actuation step, the piston 410 is moving in an upstream direction, thus pulling the rod 408 along the same direction. The force exerted by the piston 410 on the rod 408 breaks the shearing element 414 so that the rod moves freely relative to the upper cone part 422, i.e., the upper cone part 422 is freed from the rod. However, the rod is still attached to the lower slip part 440 and thus, while the rod 408 is pulled out of the plug 420, the lower slip part 440 is forced toward the upper cone part 422 as illustrated in FIG. 8. Note that the downstream end 402A of the body 404 of the setting tool 402 is in contact with the plug, thus preventing the upper cone part 422 from moving in the upstream direction. This results in a relative movement of the upper cone part 422 relative to the lower slip part 440, which makes the slips 442 to move over the wedges 428 and pressing the seal 448 toward the casing 430, as also illustrated in FIG. 8.

Figure 9:
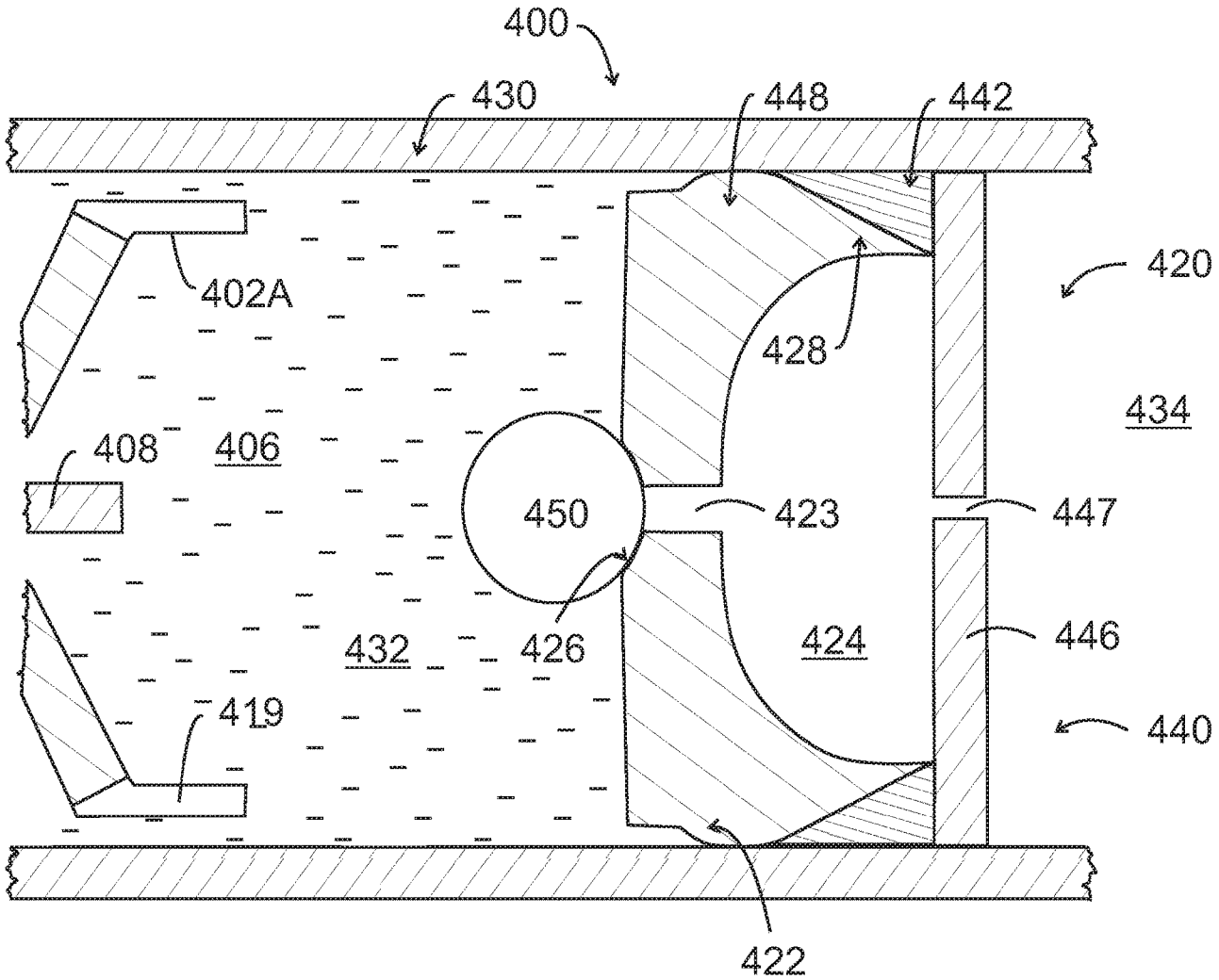
FIG. 9 illustrates a ball released by the setting tool and blocking a fluid flow through the plug.

As the force applied by the piston 410 on the rod 408 increases, the lower slip part 440 has moved as close as possible to the upper cone part 422 and the shear element 412 breaks away. Thus, in step 704, the plug 420 is being set and the rod 408 is being released from its engagement with the plug 420. Because the lower section 440 of the plug 420 is being pulled upward into the upper section 422, this process is termed in the art as a "bottom set process" or design. In step 706, the setting tool 402 is being pulled upstream with a given distance (e.g., couple of feet) so that the ball 450 is released from chamber 406 and free to engage its seat 426, as illustrated in FIG. 9. FIG. 9 shows the ball 450 blocking the well fluid 460 from moving from the upstream portion 432 into the downstream portion 434. Thus, the ball 450 and the plug 420 act now as a check valve, which blocks downstream flow of the fluid 460, but allows upward flow of the same fluid. With this configuration in place, the fracturing of the casing can now proceed.

Figure 10:
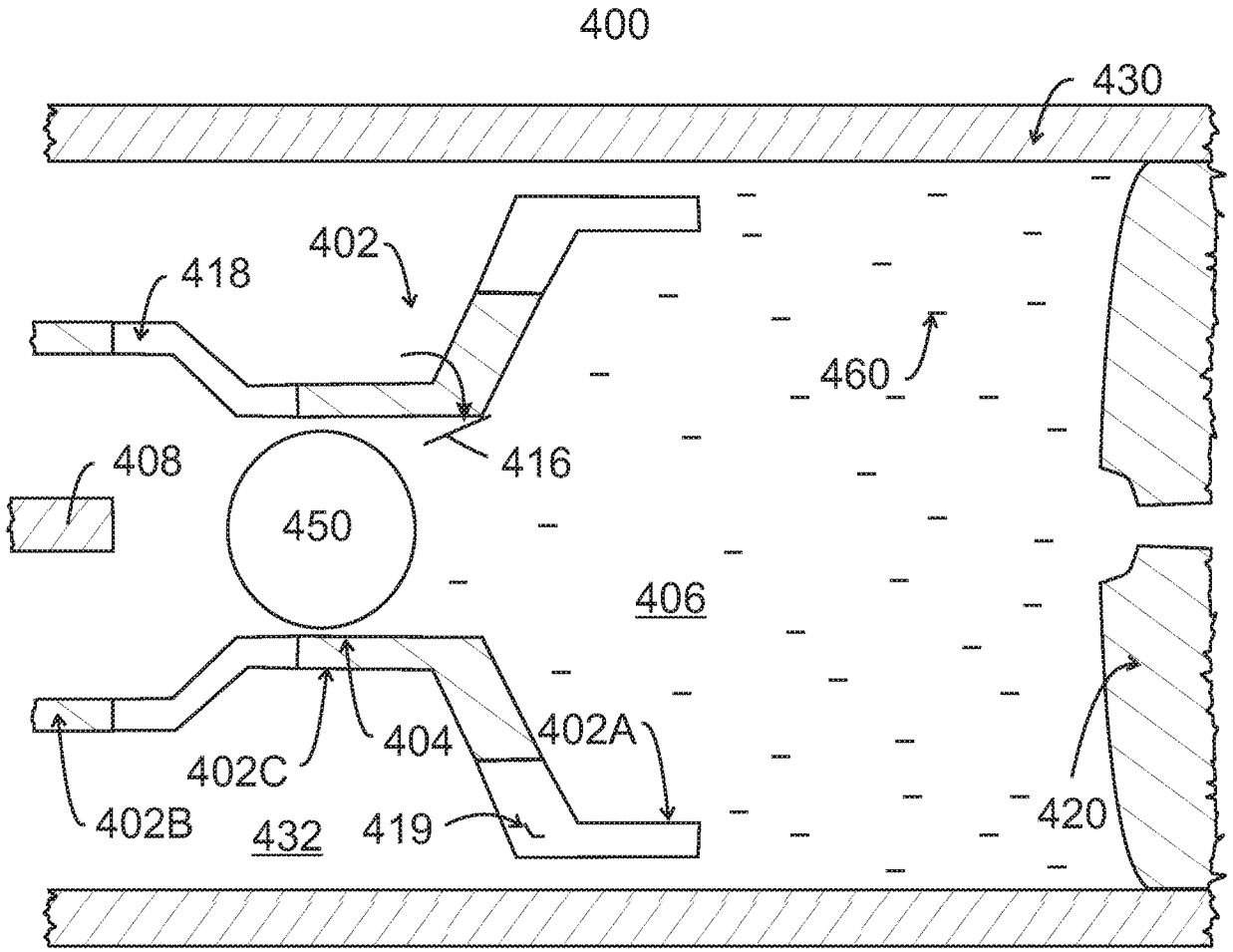
FIG. 10 illustrates how the ball is retrieved and trapped inside the setting tool.

When it is desired to retrieve the ball from the plug, for example, after the fracturing operation has concluded, the well flow is reversed, i.e., a flow-back is applied to the well. The flow-back may be achieved by reducing the fluid's pressure upstream the plug, for example, with pumps located at the surface. Because the fluid's pressure above the ball is decreasing while the pressure of the fluid trapped behind the ball remains at a high pressure, the ball moves in step 708 upward, thus reestablishing the fluid flow between the downstream portion 434 and the upstream portion 432 of the casing 430. This flow-back process makes the ball to enter chamber 406, as illustrated in FIG. 10, to pass the trap mechanism 416, and to get caught inside the body 404 of the setting tool 402.

In step 712, the setting tool 402 is retrieved from the well. While the setting tool and the ball travel through the casing 430, for example, when the setting tool is lowered into or raised from the well, the fluid 460 can easily bypass the setting tool because of the slots and holes 418 and 419 formed in the body 404 of the setting tool. In one application, part of the body 404 is located very close to the inner diameter of the casing so that the largest ball possible can be installed in the setting tool. In one application, the shape of the body 404 can be selected to require the least amount of machining and the maximum reverse flow. As the setting tool is removed from the well, if the body is a close fit to the inner diameter of the casing, traditionally, a large pressure drop is caused between the upstream end of the body and the downstream end because the fluid above the setting tool has to go around the body through a narrow space, which reduces the amount of fluid that can bypass the body. This is called "swabbing the well." However, with the setting tool discussed above, the setting tool moves easily in an upstream direction due to the slots and holes 418 and 419, which allow a large amount of the fluid to bypass the body.

The previous embodiments have been discussed with specific details for enabling one skilled in the art. However, those skilled in the art would understand that various modifications of the previous embodiments are possible without affecting the capabilities of the setting tool and plug. For example, in one embodiment, the holes 423 and 447 do not have to be centered relative to the plug 420. The ball 450 does not have to be in fact a ball. It can be a cylindrical plug or any other device that creates a flow restriction. The ball can be made of any material, for example, a composite or a degradable material. While the plug has been shown and discussed as having slips only on one side of the seal, for easier milling, it is possible to use the traditional plugs (having two sets of slips) with the setting tool discussed herein.

The disclosed embodiments provide methods and systems for plugging a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A setting tool for setting a plug in a well, the setting tool comprising:

a body extending along a longitudinal axis X;

a rod extending along the longitudinal axis of the body, from an upstream end to a downstream end of the body;

a chamber formed at the downstream end of the body; and a ball located in the chamber and configured to move freely inside the chamber, wherein the rod extends through the entire chamber and the ball is located between the rod and a wall of the chamber, and wherein the rod has a first portion having a first diameter, a second portion having a second diameter, and a third portion having a third diameter, the second diameter is larger than the first diameter, and the third diameter is larger than the second diameter.

2. The setting tool of claim 1, wherein the first portion of the rod has a first shear element and the second portion of the rod has a second shear element.

3. The setting tool of claim 2, wherein the first and second shear elements are shear pins.

4. The setting tool of claim 1, wherein the first and second portions of the rod extend beyond the downstream end of the body of the setting tool.

5. The setting tool of claim 1, wherein the body has plural slots formed in the downstream end and plural holes formed in the upstream end so that a fluid present in the well passes through the body.

6. The setting tool of claim 1, wherein an external diameter of the downstream end of the body substantially matches an internal diameter of the casing.

7. The setting tool of claim 1, further comprising:

a trap mechanism located in a middle part of the body, between the upstream and downstream ends, wherein the trap mechanism traps the ball at the upstream end.

8. The setting tool of claim 1, further comprising:

a piston attached to an end of the rod; and an actuation mechanism configured to actuate the piston so that the rod moves relative to the body.

9. A setting tool for setting a plug in a well, the setting tool comprising:

a body extending along a longitudinal axis X;

a rod extending along the longitudinal axis of the body, from an upstream end to a downstream end of the body;

a chamber formed at the downstream end of the body; and a restriction element located in the chamber, wherein the rod extends through the entire chamber and the restriction element is located between the rod and a wall of the chamber, wherein the rod has a first portion having a first diameter, a second portion having a second diameter, and a third portion having a third diameter, the second diameter is larger than the first diameter, and the third diameter is larger than the second diameter, and wherein the first portion of the rod has a first shear element and the second portion of the rod has a second shear element.

10. The setting tool of claim 9, wherein the first and second shear elements are shear pins.

11. The setting tool of claim 9, wherein the first and second portions of the rod extend beyond the downstream end of the body of the setting tool.

12. The setting tool of claim 9, wherein the body has plural slots formed in the downstream end and plural holes formed in the upstream end so that a fluid present in the well passes through the body.

13. The setting tool of claim 9, further comprising:

a trap mechanism located in a middle part of the body, between the upstream and downstream ends, wherein the trap mechanism traps the restriction element at the upstream end;

a piston attached to an end of the rod; and an actuation mechanism configured to actuate the piston so that the rod moves relative to the body.

14. A setting tool for setting a plug in a well, the setting tool comprising:

a body extending along a longitudinal axis X;

a rod extending along the longitudinal axis of the body, from an upstream end to a downstream end of the body;

a chamber formed at the downstream end of the body; and a restriction element located in the chamber, wherein the rod extends through the entire chamber and the restriction element is located between the rod and a wall of the chamber, wherein the rod has a first portion having a first diameter, a second portion having a second diameter, and a third portion having a third diameter, the second diameter is larger than the first diameter, and the third diameter is larger than the second diameter, and wherein the first and second portions of the rod extend beyond the downstream end of the body of the setting tool.

15. The setting tool of claim 14, wherein the first portion of the rod has a first shear element and the second portion of the rod has a second shear element.

16. The setting tool of claim 15, wherein the first and second shear elements are shear pins.

17. The setting tool of claim 14, wherein the body has plural slots formed in the downstream end and plural holes formed in the upstream end so that a fluid present in the well passes through the body.

18. The setting tool of claim 14, further comprising:

a trap mechanism located in a middle part of the body, between the upstream and downstream ends, wherein the trap mechanism traps the restriction element at the upstream end;

a piston attached to an end of the rod; and an actuation mechanism configured to actuate the piston so that the rod moves relative to the body.

* * * * *